US005341974A

United States Patent [19]

Robinson et al.

[11] Patent Number: 5,341,974

[45] Date of Patent: Aug. 30, 1994

[54] BACK BAG

[75] Inventors: Doug Robinson, Aptos, Calif.; Isamu Tatsuno, Osaka, Japan

[73] Assignee: Mont-Bell Co., Ltd., Osaka, Japan

[21] Appl. No.: 901,096

[22] Filed: Jun. 19, 1992

[51] Int. Cl.[5] ..... A45F 3/04

[52] U.S. Cl. ..... 224/215; 224/211; 224/901

[58] Field of Search ..... 224/209, 210, 211, 212, 224/213, 214, 215, 216, 259, 261, 262, 263, 901, 224

[56] References Cited

U.S. PATENT DOCUMENTS

| | | | |
|---|---|---|---|
| 46,866 | 3/1865 | Dickey | 224/213 |
| D. 259,151 | 5/1981 | Kishbaugh et al. | 224/209 |
| 3,649,921 | 3/1972 | Thomas . | |
| 3,923,216 | 12/1975 | Farnbach . | |
| 4,114,788 | 9/1978 | Zufich | 224/211 |
| 4,369,903 | 1/1983 | Wilkes | 224/211 |

FOREIGN PATENT DOCUMENTS

| | | | |
|---|---|---|---|
| 0122764 | 10/1984 | European Pat. Off. . | |
| 3829145 | 3/1990 | Fed. Rep. of Germany . | |
| 4007382 | 9/1991 | Fed. Rep. of Germany . | |
| 2464673 | 3/1981 | France . | |
| 2666969 | 3/1992 | France . | |
| 69067 | 11/1948 | Norway . | |
| 9105493 | 5/1991 | PCT Int'l Appl. | 224/215 |

OTHER PUBLICATIONS

European Search Report dated Sep. 30, 1993.

*Primary Examiner*—Linda J. Sholl

*Attorney, Agent, or Firm*—Fish & Richardson

[57] ABSTRACT

A back bag such as a back pack, knapsack or a tucksack has a bottom-equipped bag portion, a pair of shoulder straps provided on the body-contact side of the bag portion and adapted to be hung from the user's shoulders, and a hip belt extending from a lower portion of the body-contact side of the bag portion to surround the user's hip bone. The hip belt is made of a left belt and a right belt connected by fastener, so that the hip belt is adjustable in its entire length or its angle of extension.

6 Claims, 6 Drawing Sheets

BACK BAG

BACKGROUND OF THE INVENTION

1. Field of the Invention

The present invention relates to a bag of the type which is carried on the back of a user by being suspended from the shoulders of the user, particularly to those known as a knapsack, rucksack or back pack.

2. Description of the Related Art

In general, a back bag such as a knapsack or a back pack has a pair of shoulder straps by which the bag is suspended from the user's shoulders so as to be carried on the user's back. The back bag, particularly when it is designed for use in mountain climbing or hiking, has a bag portion of a comparatively large internal volume to contain many articles which heavily burdens the user for many hours during a long-distance walk or ascending or descending steep slopes. It is, therefore, desirable that the heavy load is uniformly distributed over the entire area of the user's body, particularly his shoulders, back and waist, and that such a uniform distribution is maintained during movement of the user's body.

To cope with such a demand, back bags have been proposed on which a hip belt is provided in addition to a pair of shoulder straps, as disclosed in Japanese Utility Model Laid-Open Nos. 55-89322 and 56-27029 and Japanese Patent Laid-Open No. 61-247409. The hip belt is adapted to be fastened around the user's hip bone, on which the load of the articles is stably borne.

These conventional back bags, however, are designed and constructed such that the hip belt is integrally fixed on the bag portion by sewing or other means. Thus, there still exists a problem that the hip belt cannot be worn around his hip bone in sufficient conformity with the user's physical shape.

SUMMARY OF THE INVENTION

Accordingly, the present invention has been made in order to overcome the above-mentioned problem of the prior art. It is an object of the present invention to provide a back bag with a hip belt, which is adjustable and enables the user to wear the hip belt in sufficient conformity with the user's physical shape around his hip bone, and thereby to uniformly distribute the load of the articles in the bag over the user's entire body.

To this end, according to the present invention, there is provided a back bag comprising: a bag portion; a pair of shoulder straps provided on a body-contact side of the bag portion and adapted to be hung from the user's shoulders; and a hip belt extending from a lower portion of the body-contact side of the bag portion to surround the user's hip bone, said hip belt having a left belt and a right belt connected by connecting means which is capable of adjusting the respective connecting positions of the belts within a predetermined range, thereby being adjustable in conformity with the geometry of the user's hip bone.

By virtue of the adjustment of the position for connecting the right and left belts using the connecting means, it becomes possible to adjust the overall length of the hip belt and the angle of extension of the right and left belts and, accordingly, it enables the user to wear the hip belt tightly around his hip bone even if the geometry of the user's hip bone varies depending on the user.

The above and other objects, features and advantages of the present invention will become clear from the following description of the preferred embodiment when the same is read in conjunction with the accompanying drawings.

DESCRIPTION OF THE PREFERRED EMBODIMENT

The invention will be described in detail with reference to the accompanying drawings which show an embodiment of the present invention.

Figure 1:
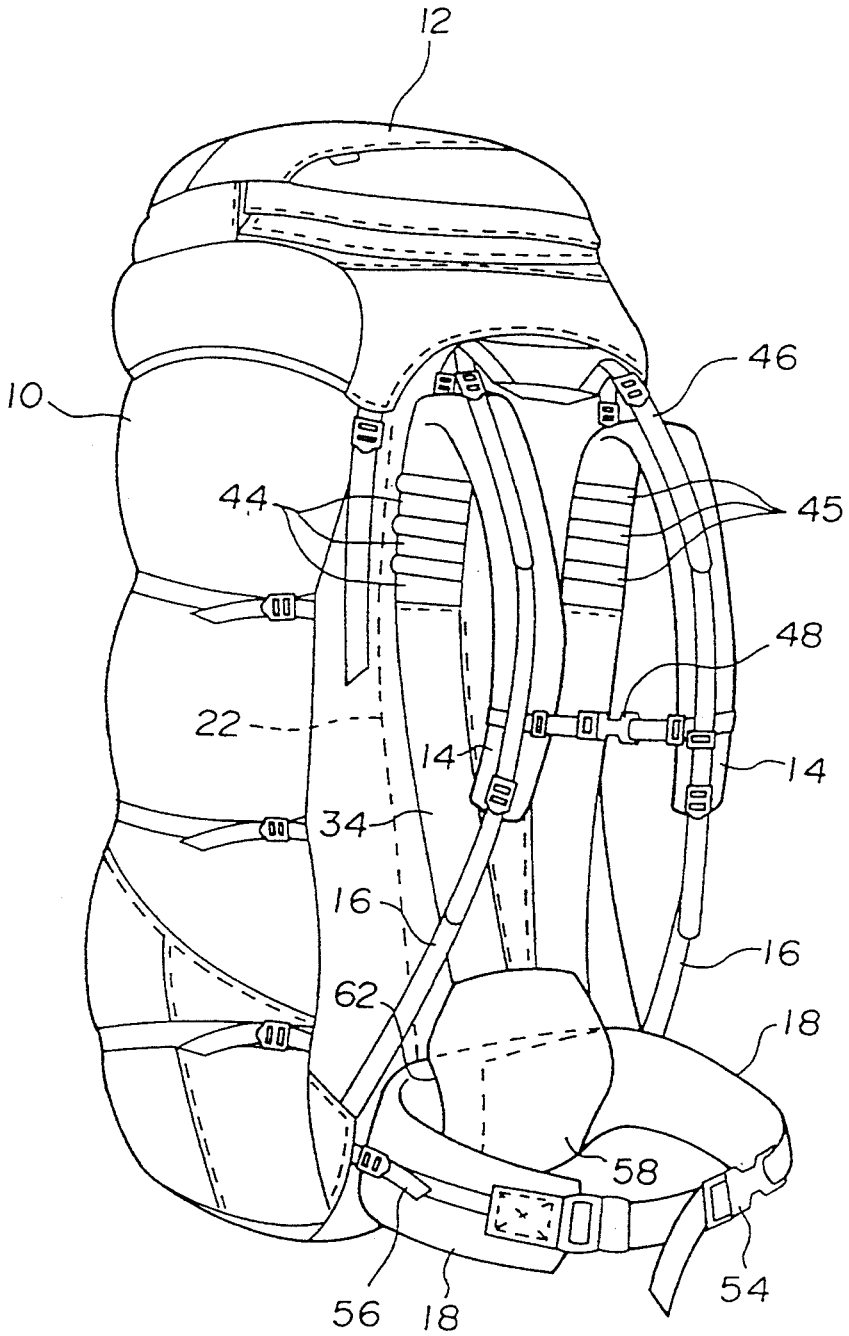
FIG. 1 is an elevational view of an embodiment of the back bag in accordance with the present invention, as viewed from the side adjacent to the user's body.

FIG. 1 illustrates an embodiment of the back bag of the present invention, more specifically a back bag of the type generally referred to as "back pack," as viewed from the back (as referred to "body-contact side" hereinafter) adjacent to a user's body when the user carries the bag. The back bag has a bag portion 10 which is usually made of a woven or non-woven fabric of natural or synthetic fibers so as to have suitable levels of flexibility and rigidity. The bag portion 10 has a generally tubular form with a bottom, and is designed to have a detachable cover 12 on the top thereof. The body-contact side of the bag portion 10 is generally flattened and is provided with a pair of shoulder straps 14 connected thereto. More specifically, the shoulder straps 14 are connected through webbings 16 to both lateral lower end portions of the bag portion 10 so as to be suspended from the user's shoulders in symmetry. A hip belt 18 provided on the lower end of the bag portion 10 has portions which extend to right and left from the respective lateral lower ends of the bag portion 10 at the body-contact side so as to surround the hip bone of the user when the user carries the bag.

Figure 2:
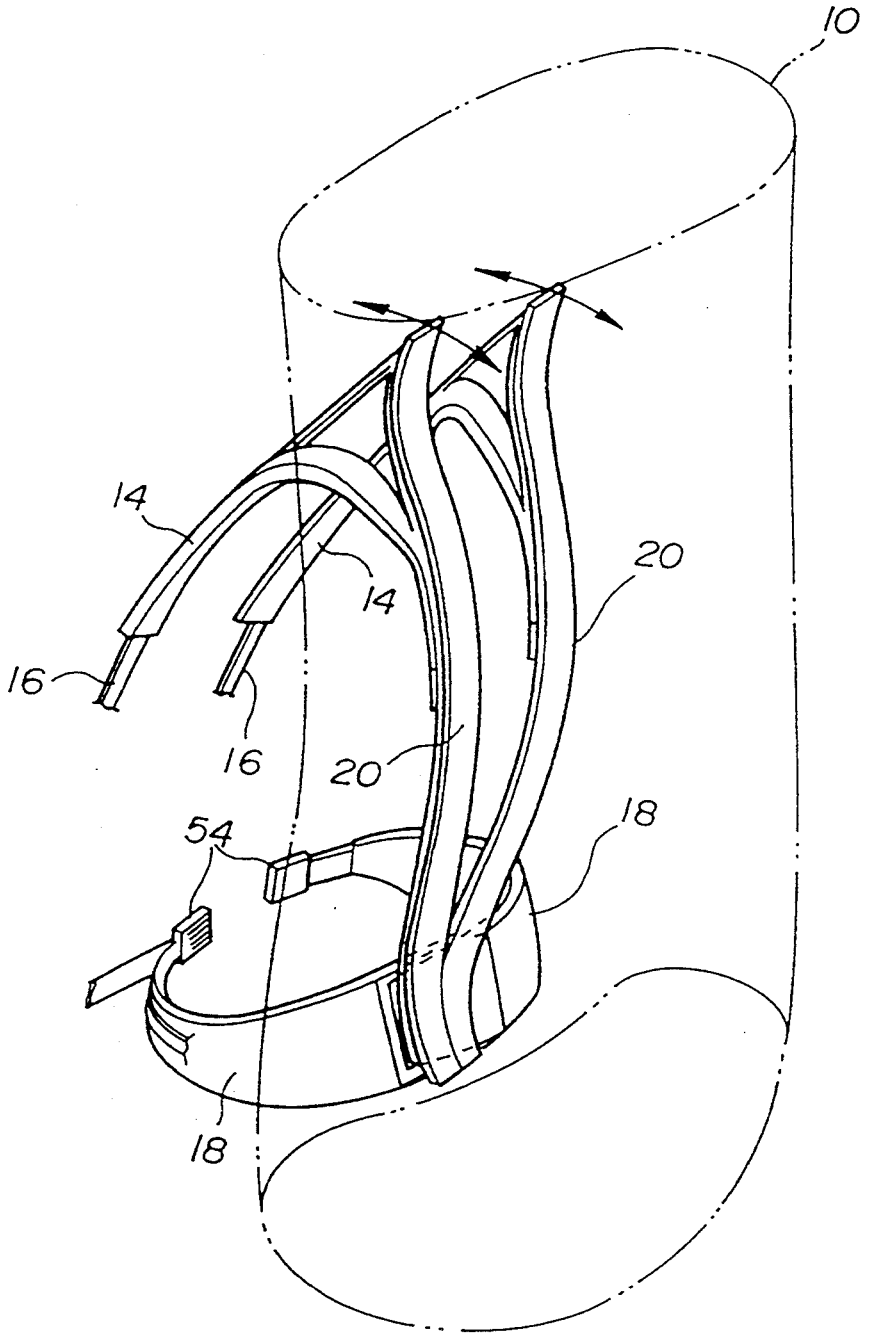
FIG. 2 is a perspective view of a critical portion of the embodiment.
Figure 3:
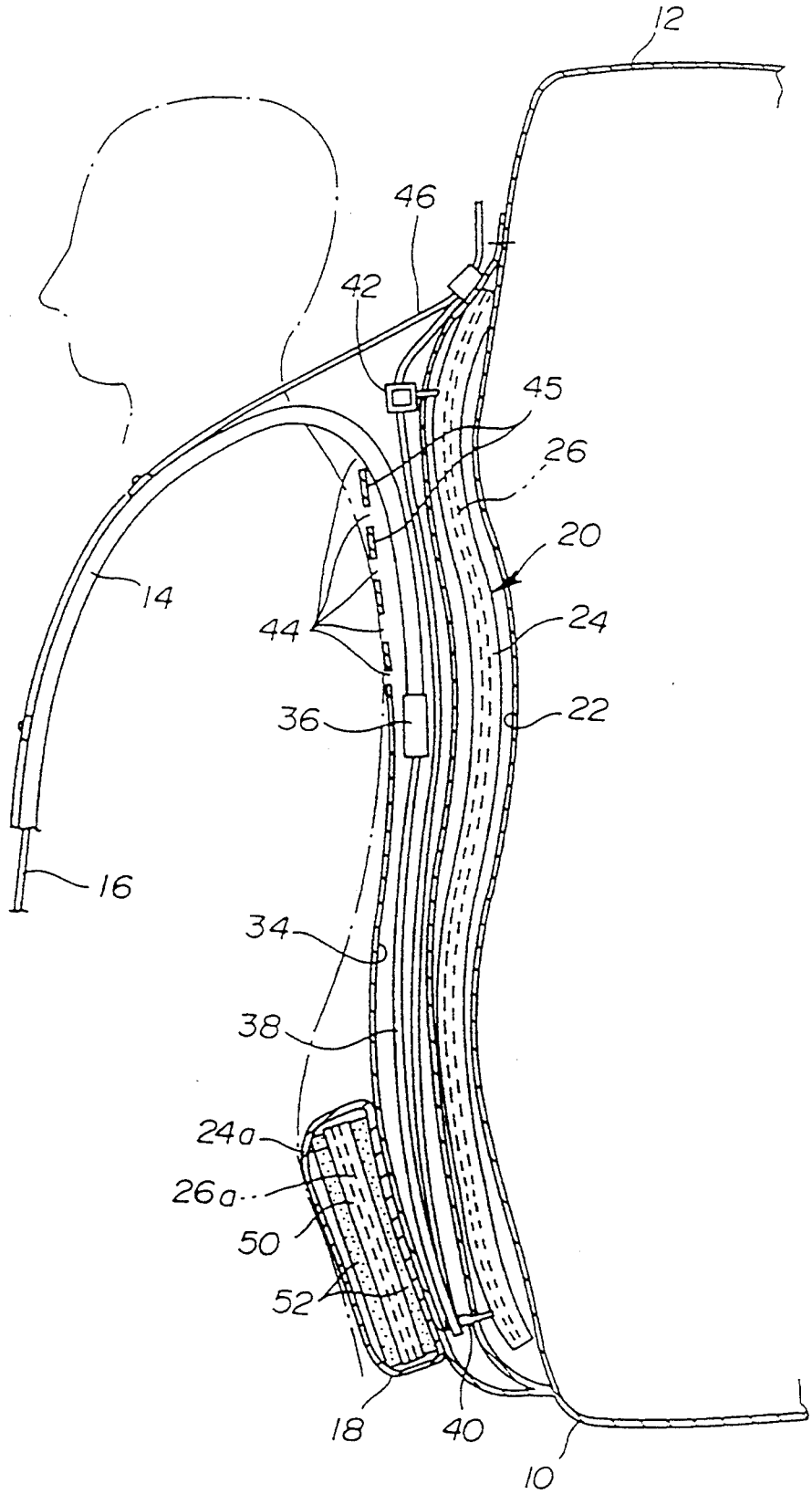
FIG. 3 is a sectional side view taken down the center of the back bag of FIG. 1.
Figure 4:
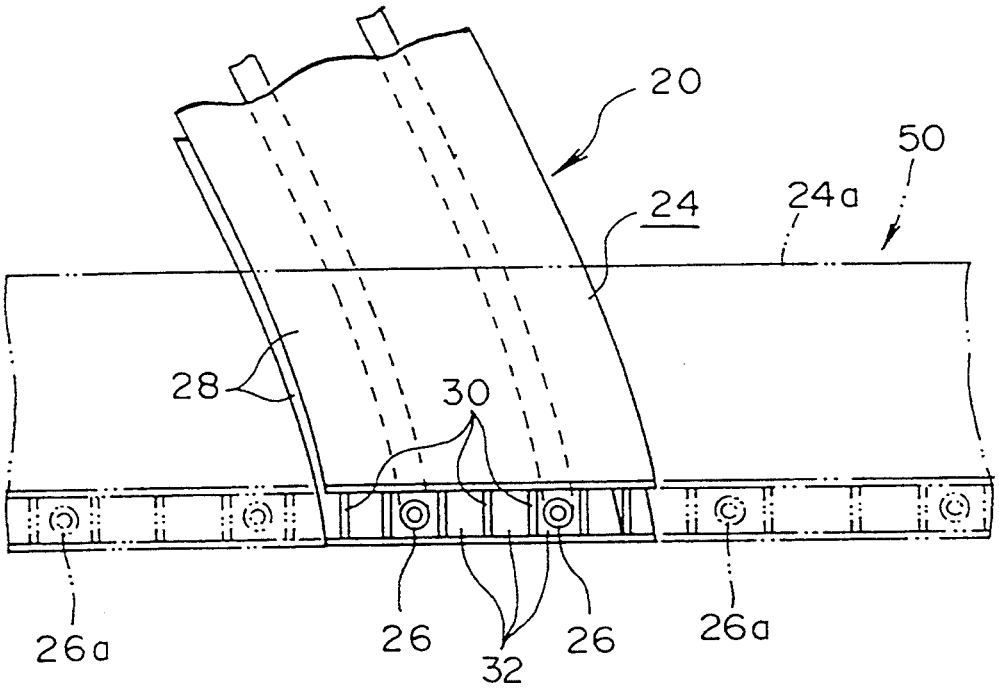
FIG. 4 is a partly-sectioned perspective view of a portion of a frame used in the embodiment.

Referring to FIG. 2 or 4, a substantially V-shaped frame 20 is provided on the body-contact side of the bag portion 10 so as to lie in symmetry with respect to the longitudinal axis of the bag portion 10. A pair of frame-receiving sheathes 22, arranged in a generally V-like form, are provided in the body-contact side wall of the bag portion 10 so as to receive respective inclined straight wing portions of the frame 20, as shown in FIG. 3. Thus, both wing portions of the V-shaped frame 20 are received in the respective frame-receiving sheathes 22. In the illustrated embodiment, both lower ends of the wing portions of the V-shaped frame 20 are not connected to each other. The lower end or apex of the V-shape where these inclined straight portions meet each other is positioned such that it is located in the vicinity of the lower end of the backbone of the user's body when the user carries the bag.

As will be seen from FIG. 4, each wing portion of the frame 20 has a narrow board-like frame body 24 including thin-walled and light-weight walls 28 of a synthetic resin and soft metallic members 26 extended through the frame body 24. The frame body 24 is made of a suitable synthetic resin which provides suitable levels of elasticity and rigidity. The metallic members 26 is made of a suitable metallic material which, when assembled in the frame body 24, plastically deforms under a predetermined ranges of force applied thereto, so as to maintain the frame 20 in the deformed state against the rigidity of the frame body 24 even after the removal of the force. More specifically, the frame body 24 is preferably but not exclusively made of a thermoplastic resin, particularly polyethylene or polypropylene. The metallic member 26 is preferably a rod, wire or pipe of aluminum, although other suitable metallic materials in various forms are usable.

As will be seen from FIG. 4, the frame body 24 has a pair of walls 28 and a plurality of partitions 30 interconnecting both walls 28, which define a plurality of bores 32 in the area enclosed with said partitions extending in the longitudinal direction of the frame body 24. Such a frame body is commercially available without any difficulty. The soft metallic members 26 are inserted into and received in these bores 32. It is not necessary to insert the metallic members 26 into all these bores 32. Thus, the number and positions of the metallic members are to be determined in relation to the nature of the frame body 24, so as to obtain a required plastic deformation of the whole frame 20 at least in the longitudinal direction under a predetermined range of force as described before and so as to minimize the weight of the whole frame 20. In the frame 20 thus constructed, the frame body 24 gives structural strength and rigidity to the body-contact side of the bag portion 10, while the soft metallic members 26 allows the frame 20 to flex to a form conforming with the geometry of the user's back and to maintain this form. Thus, the user can adjust the form of the frame 20 by hand, without using any specific tool, so as to adapt it to the form of the user's back. This adjustment of the frame 20 can be done while the frame 20 is set in the bag portion 10. However, the adjustment can be done more easily if the wing portions of the frame 20 are easily extracted from the bag body 10.

The aforementioned shoulder straps 14 are positioned to oppose both wing portions of the substantially V-shaped frame 20. As will be best seen from FIG. 3, the base end portion of each shoulder strap 14 is received in a strap-receiving sheath 34 which is formed immediately on the frame-receiving sheath 22 for receiving corresponding wing of the V-shaped frame 20. The end extremity of the base end of the strap 14 is connected, through a reinforcement plate 34 made of, for example, a synthetic resin, to a webbing 38 which extends to the bottom of the strap-receiving sheath 34. The webbing 38, after making a turn on a turn piece 40 provided at the bottom of the strap-receiving sheath 34, extends upward so as to be connected to an adjustable buckle 42 which enables adjustment of the length of the strap. Preferably, the turn piece 40 and the buckle 42 are fixed to the corresponding wing of the V-shaped frame 20. The user, therefore, can pull the webbing 38 by means of the buckle 42 or the shoulder strap 14 so as to adjust the length of each shoulder strap 14 projecting from the body-contact side of the bag portion 10. The upper end region of strap-receiving sheath 34 is cut at a plurality portions so as to provide openings 44 substantially at a constant pitch in the heightwise direction. In other words, a plurality of strips 45 are positioned at a constant pitch as an extension of the strap-receiving sheath 34. Each of these openings 44 can function as an outlet through which the shoulder strap 14 is extracted. It is possible to adjust the heightwise position at which the shoulder strap extends apart from the body-contact side of the bag portion 10 by selecting the outlet opening 44.

Since the shoulder straps 14 are secured to the bag portion 10 in alignment with the respective wings of the V-shaped frame 20, part of the load of the articles in the bag portion 10 is uniformly shared by both shoulder straps 14, whereas the remainder part of the load is mainly borne by the portion of the user's body near the lower end of the backbone, since the lower end of the substantially V-shaped frame 20 is located near the lower end of the backbone. As a consequence, concentration of the load to the shoulders, which has been inevitable in known back bags, is avoided. When the user stoops or straightens his back during walking or other motion, the change in the form of the user's back is transmitted to the frame 20 through the shoulder straps 14. Since both wings of the substantially V-shaped frame 20 are freed from each other at their lower ends, and since these wings are elastically deformable independently of each other as indicated by arrows in FIG. 2 due to the nature peculiar to the frame, the wings of the frame 20 can easily be deformed following up the change in the configuration of the user's back to enable the body-contact side of the bag portion 10 to fit on the user's back, thus preventing the bag portion 10 from jumping off the user's back or sliding sideways on the user's back.

Referring to FIG. 1, numeral 46 denotes a reinforcement strap which serves to stably fix each shoulder strap 14 to the body-contact side of the bag portion 10, while 48 denotes buckles which serve to prevent the pair of shoulder straps from moving apart from each other when they are hung from the user's shoulders.

The hip belt 18 is provided in order to hold the lower end portion of the bag portion 10 in close contact with the user's body. The hip belt 18 is separated into two portions as described below and has its central connecting portion located near the lower end of the backbone of the user's body, i.e., in alignment with the lower end of the substantially V-shaped frame 20. The hip belt 18 has portions which extend from the center to the left and right. Referring specifically to FIG. 3, the hip belt 18 has a reinforcement frame 50 (as shown with phantom lines in FIG. 4) which is composed of, as in the case of the frame 20, a frame body **24*a* of thin synthetic resinous walls, which may contain soft metallic members 26*a* embedded in the frame body 24*a*, the reinforcement frame 50 being sandwiched between sheets of a buffering material such as sponge. In this hip belt 18, the metallic members 26*a* are plastically deformable to some extent along the extension of the soft metallic members 26*a*, i.e., in the widthwise direction of the hip belt 18, so that the configuration of the hip belt 18 can be adjusted in conformity with the geometry of the user's hip. In this embodiment, therefore, the load of the articles in the bag portion 10 is distributed also to the hip belt 18 through the substantially V-shaped frame 20** so as to be uniformly distributed to the region near the lower end of the backbone, as well as around the hip bone, of the user's body, thus enabling the load to be carried stably.

Numeral 54 denotes a buckle through which the opposing ends of both extending portions of the hip belt 18 are connected together. Numeral 56 denotes reinforcement straps for securely connecting the hip belt 18 to the bag portion 10, while numeral 58 denotes a back pad which fixes the central portion of the hip belt 18 to the bag portion 10 and which is held directly adjacent to the lower end of the user's backbone.

Figure 5:
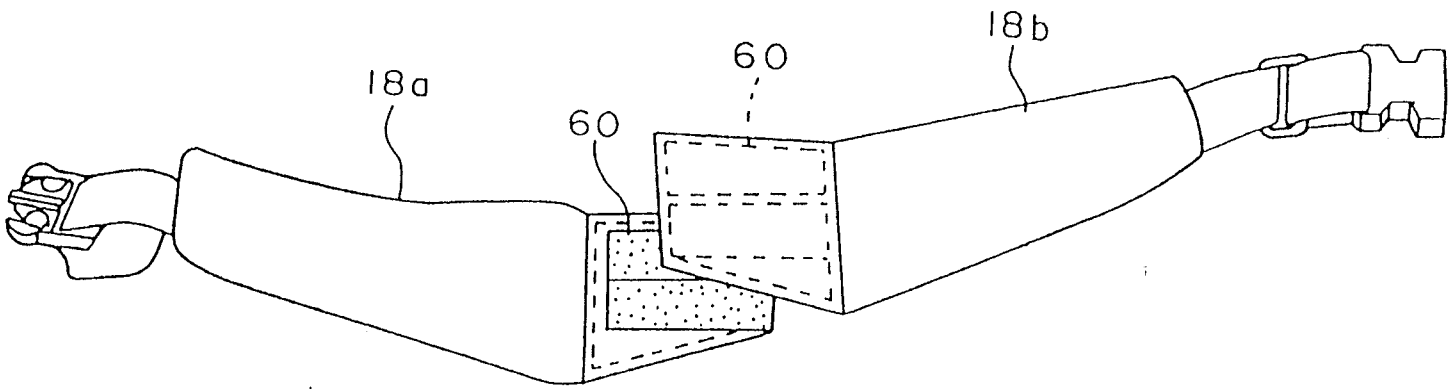
FIG. 5 is an exploded view of a hip belt used in the embodiment.
Figure 6:
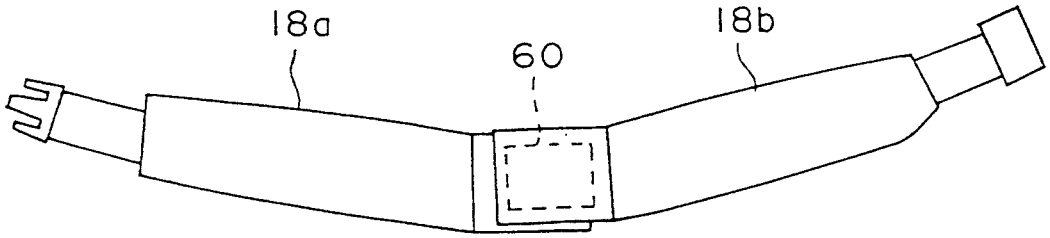
FIGS. 6(A) to 6(D) are elevational views of the hip belt in various adjustment conditions.
Figure 6:
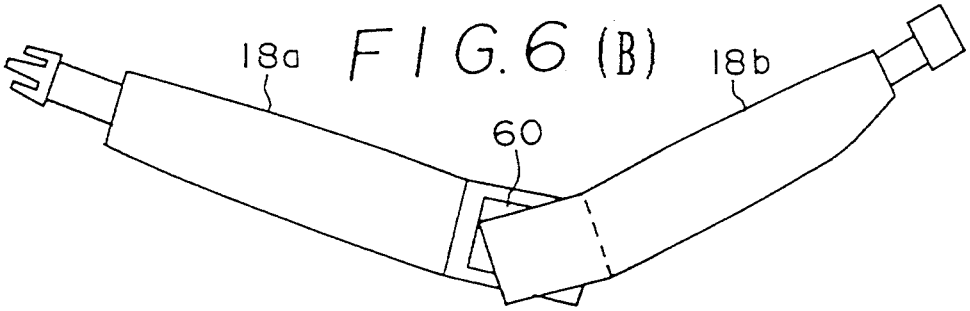
Figure 6:
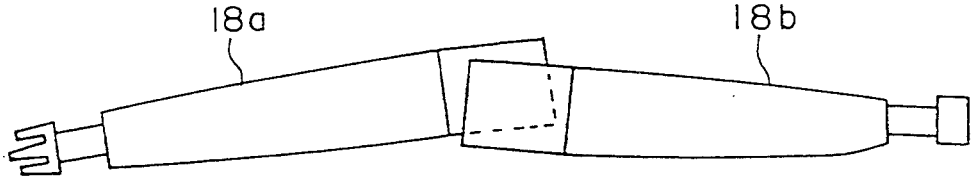
Figure 6:
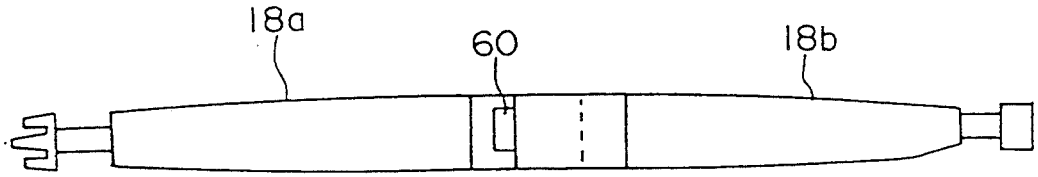

As shown in FIG. 5, the hip belt 18 is constructed by connecting a left belt 18*a* and a right belt 18*b*, each of which is formed as a separate member. A connecting member 60 is provided over a predetermined area on the opposing surfaces of the base end portions of the belts 18*a* and 18*b*. Preferably, this connecting member 60 is capable of connecting both belts 18*a* and 18*b* at a desired position by simply pressing the base end portions of said belts against one another. For example, it is preferable to use Velcro Fastener (trademark) as the connecting member 60. By virtue of such construction, the user can freely adjust not only the angle of extension of the right and left belts but also the length of the hip belt as a whole, as shown in FIG. 6. Therefore, the hip belt 18 is adjustable to various geometries of the user's hip.

In order to enable such adjustment of the hip belt 18, it is preferable not to fix the back pad 58 with the hip belt 18. In other words, the hip belt 18 may be simply inserted through an opening 62, penetrating through right to left, which is formed between the back pad 58 and the lower end portion of the bag portion 10.

As has been described, the hip belt in accordance with the present invention is constructed by connecting the right and left belts through a connecting means whose connecting position is adjustable, thereby being adjustable to various geometries of the user's hip. Therefore, the present invention has superior effects that the load of the articles in the bag can be uniformly borne over the entire area of the user's body.

What is claimed is:

1. A back bag comprising:

a bag portion;

a pair of shoulder straps provided on a body-contact side of said bag portion and adapted to be hung from the user's shoulders; and a hip belt extending from a lower portion of the body-contact side of said bag portion to surround the user's hip bone, said hip belt comprising a left belt and a right belt connected by connecting means for adjusting an angle at which said right and left belts are connected and for adjusting the length of said hip belt, whereby said hip belt is adjustable in conformity with the geometry of the user's hip bone, and wherein said hip belt is plastically deformable at least in the widthwise direction thereof in conformity with the geometry of the user's hip bone by application of a force falling within a predetermined range, said hip belt having a thin board frame body made of a synthetic resin, wherein said frame body includes at least one bore extending through said frame body in the widthwise direction thereof, and a soft metallic member is received in said bore.

2. A back bag according to claim 1, wherein said frame body is made from a thermoplastic resin and has a pair of opposing walls and a plurality of partitions which are disposed at a predetermined pitch so as to interconnect both walls so that a plurality of said bores are defined by said walls and adjacent partitions.

3. A back bag according to claim 1, wherein said metallic member is a rod or a pipe of aluminum.

4. A back bag according to claim 1, wherein a back pad is mounted on the surface of the lower portion of the body-contact side of said bag portion, and a connecting portion of the left and right belts of said hip belt is inserted between said back pad and the surface of the lower portion of the body-contact side of said bag portion.

5. A back bag according to claim 4, wherein said back pad is located near the lower end of the user's backbone.

6. A back bag according to claim 1, wherein said connecting means comprises Velcro Fastener (trademark), which is mounted respectively on the base end surfaces of the right and left belts.

* * * * *